US010174591B2

(12) United States Patent
Holtby et al.

(10) Patent No.: US 10,174,591 B2
(45) Date of Patent: Jan. 8, 2019

(54) JUNK BASKET AND RELATED COMBINATIONS AND METHODS

(71) Applicant: Katch Kan Holdings Ltd., Edmonton (CA)

(72) Inventors: Quinn A. J. Holtby, Edmonton (CA); Dallas Greenwood, Edmonton (CA)

(73) Assignee: Katch Kan Holdings Ltd., Edmonton (CA)

( * ) Notice: Subject to any disclaimer, the term of this patent is extended or adjusted under 35 U.S.C. 154(b) by 468 days.

(21) Appl. No.: 14/601,913

(22) Filed: Jan. 21, 2015

(65) Prior Publication Data

US 2015/0211338 A1 Jul. 30, 2015

Related U.S. Application Data

(60) Provisional application No. 61/932,897, filed on Jan. 29, 2014.

(51) Int. Cl.

| | |
|---|---|
| ***E21B 33/03*** | (2006.01) |
| ***E21B 41/00*** | (2006.01) |
| ***E21B 27/00*** | (2006.01) |

(52) U.S. Cl.

CPC ..... *E21B 41/0021* (2013.01); *E21B 27/00* (2013.01)

(58) Field of Classification Search

CPC ..... E21B 3/04; E21B 3/045; E21B 41/0021; E21B 27/00; E21B 33/03

See application file for complete search history.

(56) References Cited

U.S. PATENT DOCUMENTS 2,915,127 A 12/1959 Abendroth
3,783,939 A 1/1974 Edge et al.
3,910,359 A * 10/1975 Childress ..... E21B 3/04 173/165
6,032,742 A * 3/2000 Tomlin ..... E21B 33/063 166/345
7,331,384 B2 2/2008 Scrantz
7,392,840 B2 7/2008 Griffith et al.

(Continued)

FOREIGN PATENT DOCUMENTS

CA 2136375 A1 5/1996
CA 2187717 A1 4/1998
CA 2 258 064 A1 7/2000

(Continued)

OTHER PUBLICATIONS

International Search Report and Written Opinion of the International Searching Authority, dated May 4, 2015, for International Application No. PCT/CA2015/050053, 8 pages.

Katch Kan Ltd., "ISO Certified Rig Safety and Zero Spill Systems," Still images from video, 2006, 8 pages. (Screenshots).

Katch Kan Ltd., "Kelly Kan," Still images from video, Feb. 1, 2013, 8 pages. (Screenshots).

(Continued)

*Primary Examiner* — Giovanna C. Wright

*Assistant Examiner* — Brandon M Duck

(74) *Attorney, Agent, or Firm* — Seed IP Law Group LLP

(57) ABSTRACT

A junk basket, comprising: mating parts, each mating part comprising an annulus covering portion, a cylindrical wall portion, a nipple seat portion and a nipple connector secured to the annulus covering portion, the cylindrical wall portion forming an interior wall to the annulus covering part; and the mating parts when mated forming an annulus covering surface, a nipple seat and a cylindrical wall forming an interior boundary to the annulus covering surface.

17 Claims, 4 Drawing Sheets

(56) References Cited

U.S. PATENT DOCUMENTS 7,469,742 B2 12/2008 Larsen

FOREIGN PATENT DOCUMENTS

| | | | |
|---|---|---|---|
| CA | 2 355 002 | A1 | 2/2003 |
| CA | 2 743 825 | A1 | 2/2012 |
| CA | 2 797 836 | A1 | 5/2014 |

OTHER PUBLICATIONS

Katch Kan Ltd., "Rig Safety System™ (RSS™) and Zero Spill Systems™ (ZSS™)," Doghouse Poster v1.12-11, Feb. 1, 2013, 2 pages.

Katch Kan Ltd., "Surface Junk Basket™" downloaded on Oct. 8, 2013 from www.katchkan.com/products/surface-junk-basket/, 3 pages.

Katch Kan Ltd., "Well Servicing ZSS™ Solution," product brochure, Feb. 1, 2013, 1 page.

Katch Kan Ltd., "ZSS™ Advantage: Zero Spill System™," product brochure, Feb. 1, 2013, 1 page.

Katch Kan Ltd., "Catalogue: Making your job easier," 2007 edition excerpts, 8 pages.

"List of components of oil drilling rigs," Wikipedia, Nov. 17, 2013, URL=http://en.wikipedia.org/wiki/Drilling_rig_(petroleum), downloaded on Jan. 28, 2014, 4 pages.

Katch Kan Ltd., "ISO Certified Rig Safety and Zero Spill Systems," Digital video, 2006, provided on CD-ROM.

Katch Kan Ltd., "Kelly Kan," Digital video, Feb. 1, 2013, provided on CD-ROM.

* cited by examiner

JUNK BASKET AND RELATED COMBINATIONS AND METHODS

CROSS-REFERENCE TO RELATED APPLICATIONS

This application claims the benefit under 35 USC 119(e) of U.S. provisional application Ser. No. 61/932,897 filed Jan. 29, 2014.

TECHNICAL FIELD

This document relates to junk baskets and related combinations and methods.

BACKGROUND

During installation of a drilling rig a junk basket may be positioned over the annulus of a bell nipple to prevent debris or dropped tools from falling into the wellbore.

SUMMARY

A junk basket, comprising: mating parts, each mating part comprising an annulus covering portion, a cylindrical wall portion, a nipple seat portion and a nipple connector secured to the annulus covering portion, the cylindrical wall portion forming, an interior wall to the annulus covering part; and the mating pans when mated forming an annulus covering surface, a nipple seat and a cylindrical wall forming an interior boundary to the annulus covering surface.

A method comprising positioning a junk basket on a nipple, by providing the junk basket in mating parts and inserting the mating parts one at a time through an opening in a rig floor, and onto the nipple and securing the junk basket with nipple connectors.

A combination comprising the junk basket and a nipple extended from a wellhead, the mating parts being mated and nested within the nipple.

In various embodiments, there may be included any one or more of the following features: The nipple scat portions comprise one or more tapered flanges. The tapered flanges connect to both the cylindrical wall portion and the annulus covering portion and provide support for the annulus covering portion. The tapered flanges comprise plates between the annulus covering portion and the cylindrical wall portion. The tapered flanges collectively define a circumference and the circumference reduces with distance from the annulus covering portion. There are two mating parts, the mating parts forming semi-circular halves of the junk basket when mated. The connectors comprise plural over the center latches. Each mating part has one or more arc segments, each arc segment defining, one or more nipple hooks. Latches associated with a respective one of the nipple connectors are aligned in parallel to pull the arc segment towards the cylindrical wall portion from an open position to a closed position. Flanges are connected to the cylindrical wall portion and a junk surface on the annulus covering portion to provide support for the annulus covering portion. Drain apertures are in the cylindrical wall portion. Each mating part further comprises deflectors on a lower part of the junk basket, the deflector plates being slanted inwardly upward. The nipple is a bell nipple. The junk basket is positioned below a rotary table of the drilling rig, in which the mating parts are sized to fit through a dull string bore in the rotary table when unmated.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Figure 6:
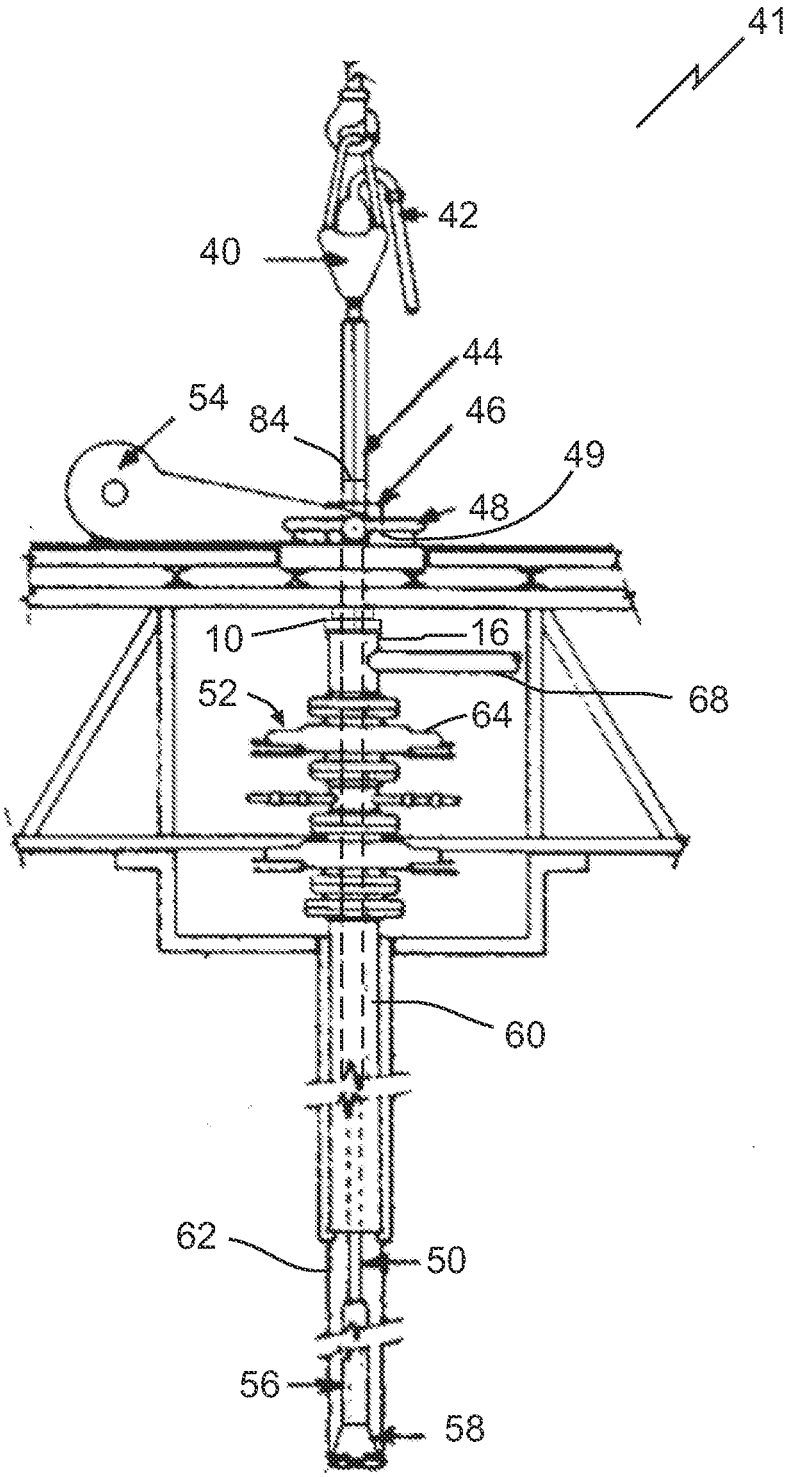
FIG. 6 is a side elevation view of the junk basket of FIG. 1 positioned on a drilling rig.

Referring to FIG. 6, a drilling rig 41 has a derrick (not shown) that suspends drilling equipment such as a swivel 40, drilling fluids hose 42, kelly drive 44, and kelly bushing 46 over a rotary table 48 above the ground or water. The kelly 44 rotates a drill string 50 that extends below the ground through a wellhead 52. A rotary drive 54 may rotate the table 48. Drilling fluids are pumped down the drill string 50 through one or more drill collars 56 and a bit 58, after which the fluids are returned with cuttings up the well annulus 60 between the bore wall 62 and drill string 50. The wellhead 52 may have one or more blowout preventers 64 above which a nipple, such as a bell nipple 16, may be located, below the rotary table 48.

A bell nipple 16 is a section of large diameter pipe that may be fitted to the top of the blowout preventers 64 or wellhead 52 such that the flow line attaches to wellhead 52 via a side outlet 68 in nipple 16, to allow the returned drilling fluid to flow back over the shale shakers (not shown) to the mud tanks (not shown).

Figure 1:
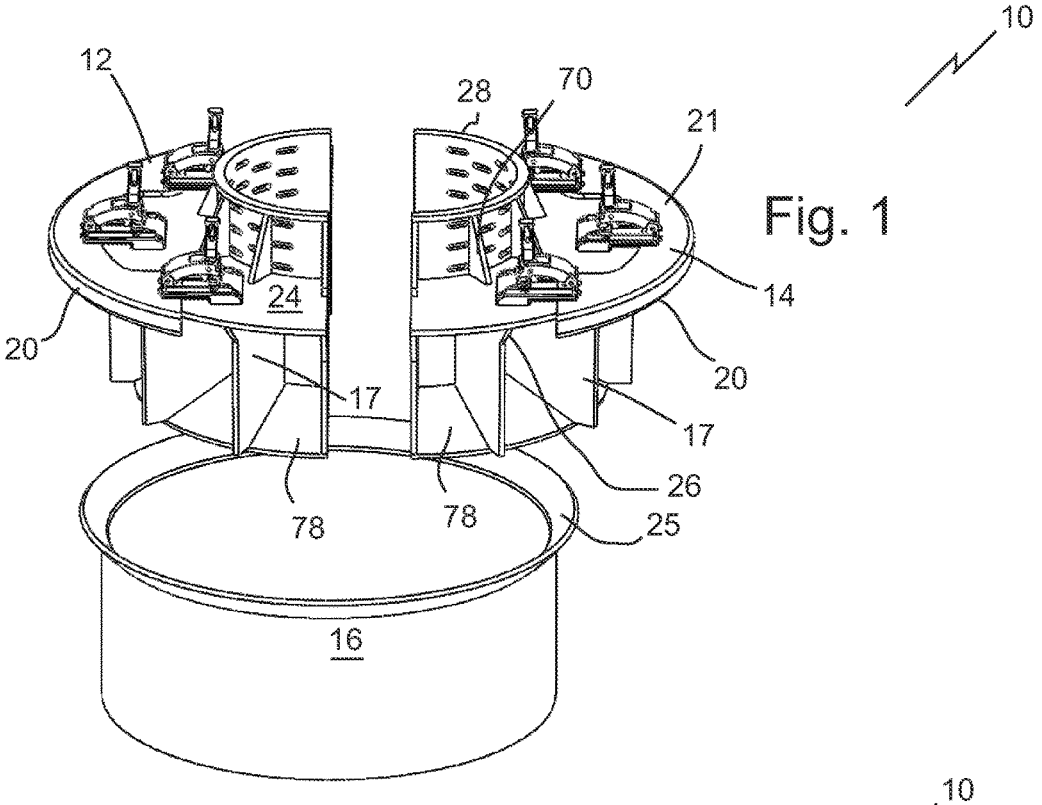
FIG. 1 is a perspective view of the separated mating parts of a junk basket positioned over a nipple.
Figure 2:
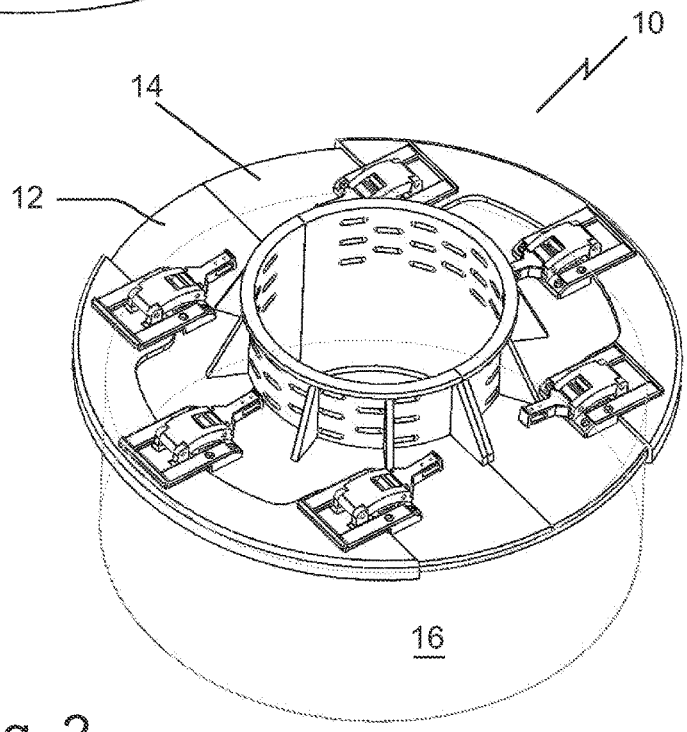
FIG. 2 is a perspective view of the mating parts from FIG. 1 assembled together and locked over the nipple.
Figure 3:
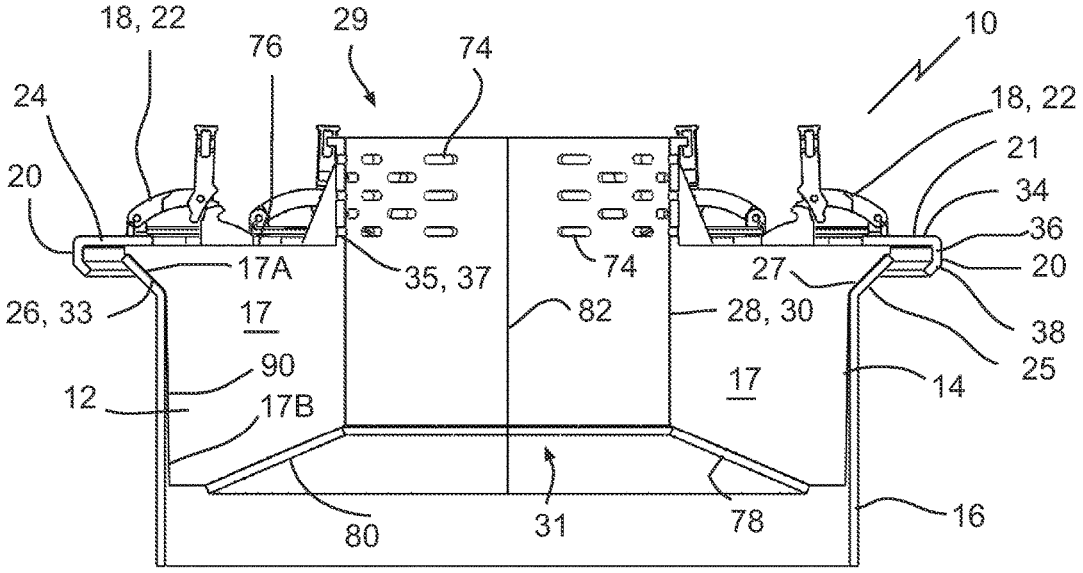
FIGS. 3 and 4 are side elevation views, in section, of the junk basket from FIG. 1 nested in the nipple and with plural hooks in the open position (FIG. 3), and after the plural hooks have been moved into the closed position to lock the junk basket to the bell nipple (FIG. 4).
Figure 4:
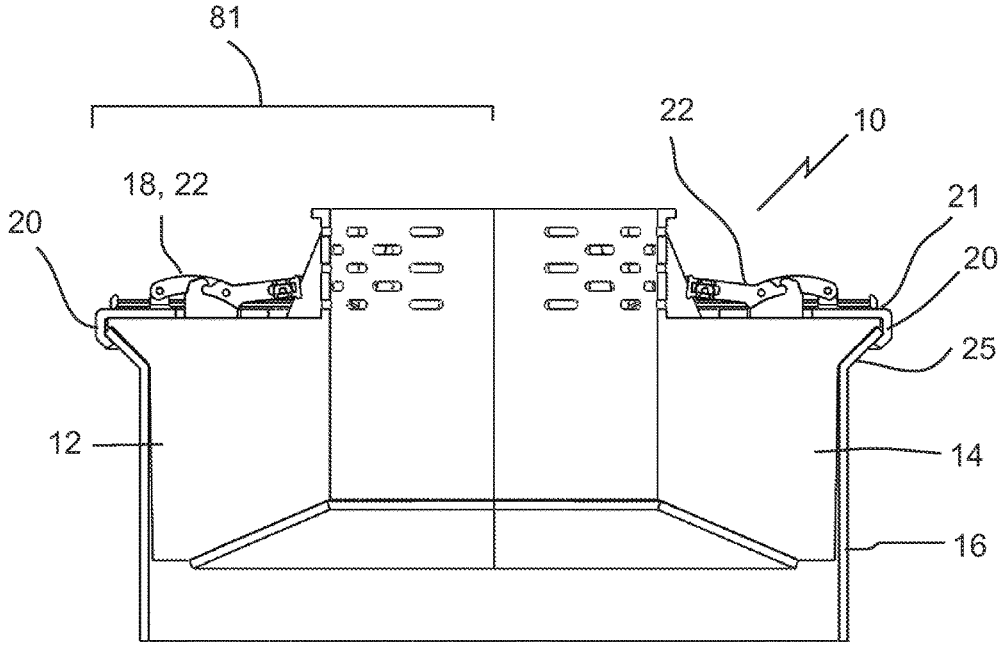
Figure 5:
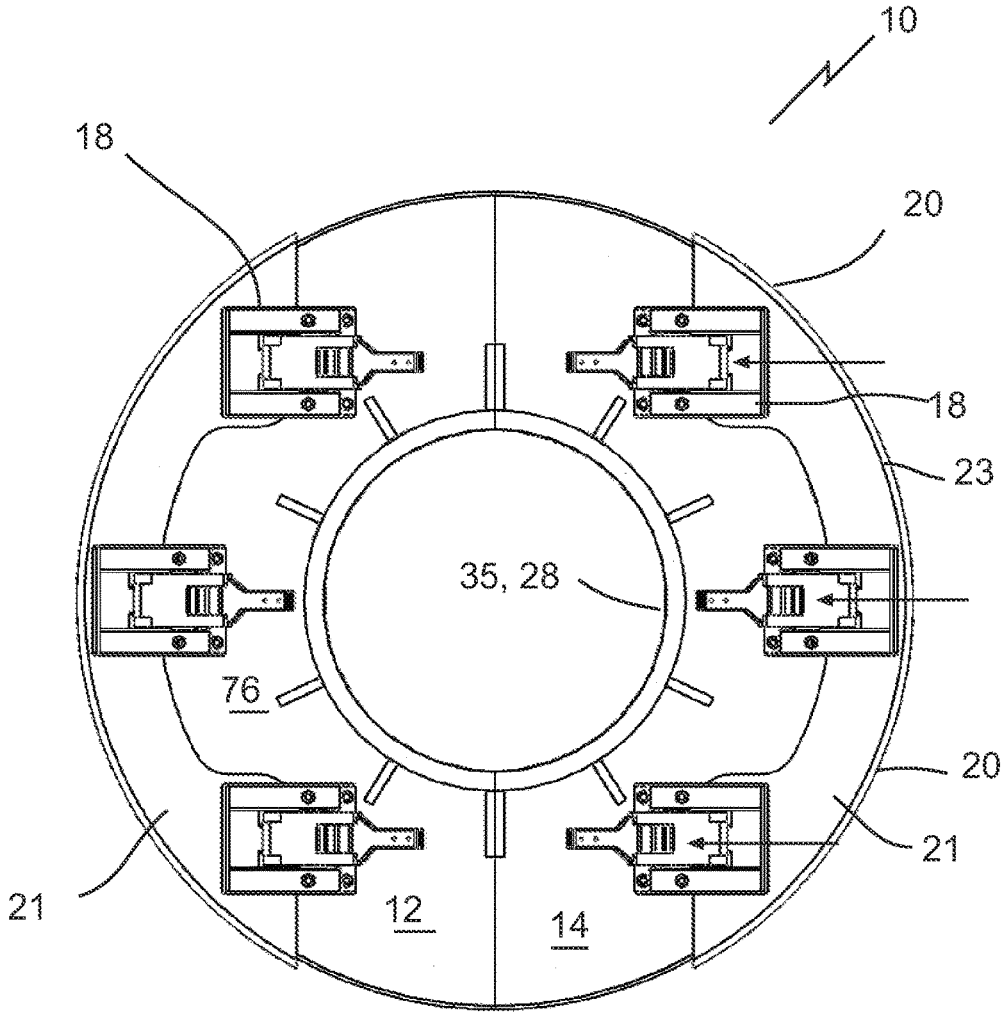
FIG. 5 is a top plan view of the junk basket of FIG. 1.

Referring to FIGS. 1-5 a junk basket 10 is shown having mating parts 12 and 14. In this example, there are two mirror image mating parts 12 and 14, but more may be used. The parts are mating in that they have edges that elm be placed together to form a single device. The mating parts 12 and 14 may form semi-circular halves of the junk basket 10 when mated (FIGS. 2 and 5). The mating parts 12 and 14 may fit together in use by being press fit from pressure from a nipple 16 into which the junk basket 10 is inserted. The junk basket 10 may be made of any suitable material such as steel or a polymer, but is preferably made from lightweight material that is resistant to corrosion, for example polymer.

Each mating part has an annulus covering portion 24, a nipple seat portion 26, and a cylindrical wall portion 28 (FIGS. 1 and 3), In use a junk end 29 and a nipple end 31 of the will portion 28 may extend out of and into, respectively, the nipple 16 (FIG. 3). The cylindrical wall portion 28 may form an interior wall 35 to the annulus covering portion 24. The mating parts 12 and 14 when mated form an annulus covering surface 76 (FIG. 5), a nipple seat 33 (FIG. 3) and a cylindrical wall 30 forming an interior boundary 37 to the annulus covering surface 76 (FIG. 3).

One or more nipple connectors 18 are secured to the annulus covering portion 24 and may have hooking parts such as one or more nipple hooks 20 (FIGS. 3-4). Each mating pan 12 and 14 may have one or more arc segments 21 (FIGS. 1 and 5) that form part of the nipple connectors 18. Each arc segment 21 may have an outside edge 23 that defines a continuous nipple hook 20 (as shown) or plural nipple hooks (not shown). The arc segments 21 may be extended and contracted through the use of one or more over the center latches 22 (FIGS. 3 and 4, respectively), which form part of the nipple connectors 18. The latches 22 associated with a respective one of the nipple connectors 18 may be aligned in parallel (FIG. 5) to pull the arc segment 21 towards the cylindrical wall portion 28 from an open position (FIG. 3) to a closed position (FIG. 4). The hooking pan or parts 20 of the nipple connectors 18 catch or hook onto the lip of the nipple when pulled inward by the latches 22. Each arc segment may have a top arc plate 34, a sidewall 36 depending from plate 34, and a shoulder ridge 38 extended from the sidewall 36 towards the cylindrical wall 30 (FIG. 3). Plate 34, sidewall 36, and shoulder ridge 38 collectively define one or more hooks 20.

When the latches 22 are in the closed position and the basket 10 is nested inside the nipple 16 the nipple hooks 20 grip and may extend under the tapered upper lip 25 of the nipple 16 (FIG. 4). When the latches 22 are in the closed position, hooks 20 contract to put pressure on the tapered upper lip flange 25 of nipple 16. The closing pressure of connectors 18 may be adjustable to fit different nipple 16 sizes.

The nipple seat portions 26 may comprise tapered flanges 17 (FIG. 3) with two tapers. Both tapers are inward in the downward direction. The first taper 17A matches the lip 25 of the nipple 16, and the second taper 17B close fits within a throat 90 of the nipple 16. The second taper 17B allows the junk basket 10 to be seated, centered, with a close fit in a throat 90 of the nipple 16. The close fit forces the mating parts together as the second taper 17B is wedged into the throat 90. Tapered flanges 17 may be shaped to nest within tapered upper lip 25 of the nipple 16 (FIGS. 1 and 3). The tapered flanges 17 may be plates as shown, for example connected to both the cylindrical wall portion 28 and the annulus covering portion 24 to provide support for the annulus covering portion 24 (FIGS. 1 and 3). The tapered flanges 17 may collectively define a circumference 27, which reduces with distance from the annulus covering portion 24 (FIG. 3), or in other words, the diameters across the junk basket from outside flange edge to outside flange edge reduce with distance from the annulus covering portion 24.

Like the support function of flanges 17, flanges 70 may be connected to the cylindrical wall portion 28 and a junk surface 72 on the annulus covering portion 24 to provide support for the annulus covering portion 24 (FIG. 1). Flanges 70 and 17 thus act like gussets to reinforce the structure of the junk basket 10.

Drain apertures 74 may be present in the cylindrical wall portion 28, for example at or near the junk end 29 (FIG. 3). Thus, drilling fluids that spill upon annulus covering surface 76 may drain through apertures 74 back into the wellbore.

Each mating part 12 and 14 may further comprise a tapered cylindrical base portion 78, 80 or deflectors, such as deflector plates, secured to the bottom of flanges 17. The deflectors are slanted upwardly and inwardly. When the mating parts 12 and 14 are mated and pipe is being removed from a wellbore through the junk basket, the deflector plates 78, 80 help avoid pipe joints or upsets from snagging the junk basket. Portions 78 and 80 effectively form an upside-down funnel for drill string to channel through as it is removed. The funnel effect deflects drill string towards the central bore and prevents basket 10 from getting caught on the drill string joints as the drill string is removed.

Referring to FIG. 6, junk basket 10 is illustrated installed on a drilling rig 41. The junk basket 10 is positioned below rotary table 48, and the mating parts 12 and 14 are sized to fit when unmated through an opening such as a drill string bore 49 in the rig floor, for example the rotary table 48. Such a result may be possible by providing mating parts 12 and 14 with a radius 81 (FIG. 4) and axial length 82 (FIG. 3) that is smaller than a bore diameter 84 (FIG. 6) of drill string bore 49 in rotary table 48. The master bushings (not shown) may have to be removed from the rotary table 48 to permit passage of the mating parts 12 and 14 from above to below the table 48. The mating parts 12 and 14 may thus be inserted one at time through bore 49 and onto the nipple 16. The junk basket 10 may then be secured with nipple connectors 18. Mating parts 12 and 14 may be assembled upon nipple 16 after the drilling rig 41 is installed and in operation but without having to disassemble the rig 41 Removal of the mating parts 12 and 14 may be the reverse of installation.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not by virtue only of being described here, to be construed as essential to all embodiments as defined by the claims.

The embodiments of the invention in which an exclusive property or privilege is claimed are defined as follows:

1. A junk basket, comprising:

mating parts, each mating part comprising an annulus covering portion, a cylindrical wall portion, a nipple seat portion having one or more tapered flanges, and a nipple connector secured to the annulus covering portion, the cylindrical wall portion forming an interior wall of the annulus covering portion, and the nipple connector configured to engage the nipple; and the mating parts when mated forming an annulus covering surface, a nipple seat, and a cylindrical wall forming an interior boundary to the annulus covering surface, wherein the tapered flanges connect to both the cylindrical wall portion and the annulus covering portion and provide support for the annulus covering portion.

2. The junk basket of claim 1 in which the tapered flanges comprise plates between the annulus covering portion and the cylindrical wall portion.

3. The junk basket of claim 1 in which the tapered flanges collectively define a circumference and the circumference reduces with distance from the annulus covering portion.

4. The junk basket of claim 1 in which there are two mating parts, the mating parts forming semi-circular halves of the junk basket when mated.

5. The junk basket of claim 1 in which the nipple connector comprises plural latches.

6. The junk basket of claim 1 in which each mating part has one or more arc segments, each arc segment defining one or more nipple hooks.

7. The junk basket of claim 6 in which latches associated with respective nipple connectors are aligned in parallel to pull the one or more arc segments toward the cylindrical wall portion from an open position to a closed position.

8. The junk basket of claim 1 further comprising flanges connected to the cylindrical wall portion and a junk surface on the annulus covering portion to provide support for the annulus covering portion.

9. The junk basket of claim 1 further comprising drain apertures in the cylindrical wall portion.

10. The junk basket of claim 1 in which each mating part further comprises deflector plates on a lower part of the junk basket, the deflector plates being slanted inwardly upward.

11. A combination, comprising:

a junk basket positioned below a rotary table of a drilling rig, the junk basket including:

mating parts sized to fit through a drill string bore in the rotary table when unmated, each mating part comprising an annulus covering portion, a cylindrical wall portion, a nipple seat portion, and a nipple connector secured to the annulus covering portion, the cylindrical wall portion forming an interior wall of the annulus covering portion, and the nipple connector configured to engage the nipple;

the mating parts when mated forming an annulus covering surface, a nipple seat, and a cylindrical wall forming an interior boundary to the annulus covering surface; and a nipple extended from a wellhead, the mating parts being mated and nested within the nipple.

12. The combination of claim 11 in which the nipple is a bell nipple.

13. A method comprising positioning a junk basket on a nipple, by providing the junk basket in mating parts, inserting the mating parts one at a time through an opening in a rig floor and onto the nipple, and securing the junk basket to the nipple with nipple connectors.

14. The method of claim 13, comprising:

mating the mating parts, wherein the mating parts include two mating parts which form semi-circular halves of the junk basket when mated.

15. The method of claim 13 in which each nipple connector comprises plural latches.

16. The method of claim 13, comprising:

aligning latches associated with respective ones of the nipple connectors in parallel to pull one or more arc segments of the mating parts toward a cylindrical wall portion of the junk basket from an open position to a closed position, wherein each arc segment defines one or more nipple hooks.

17. The method of claim 13, comprising:

providing support for an annulus covering portion of the mating parts via flanges that are connected to a cylindrical wall portion of the junk basket and a junk surface on the annulus covering portion.

* * * * *